US008997533B2

(12) United States Patent
Kim et al.

(10) Patent No.: US 8,997,533 B2
(45) Date of Patent: Apr. 7, 2015

(54) LAUNDRY MACHINE

(75) Inventors: Soo Bong Kim, Changwon-si (KR); Jung Tae Song, Changwon-si (KR); Ig Geun Kwon, Changwon-si (KR); Suk Yun Moon, Changwon-si (KR); Sang Hun Kim, Changwon-si (KR); Hee Tae Lim, Changwon-si (KR); Dong Il Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 924 days.

(21) Appl. No.: 13/142,982

(22) PCT Filed: Dec. 30, 2009

(86) PCT No.: PCT/KR2009/008005

§ 371 (c)(1),
(2), (4) Date: Aug. 17, 2011

(87) PCT Pub. No.: WO2010/077108

PCT Pub. Date: Jul. 8, 2010

(65) Prior Publication Data

US 2012/0017650 A1 Jan. 26, 2012

(30) Foreign Application Priority Data

| | | |
|---|---|---|
| Dec. 31, 2008 | (KR) | 10-2008-0137749 |
| May 28, 2009 | (KR) | 10-2009-0047192 |
| Aug. 27, 2009 | (KR) | 10-2009-0079909 |
| Dec. 30, 2009 | (KR) | 10-2009-0134198 |

(51) Int. Cl.

| | |
|---|---|
| ***D06F 37/26*** | (2006.01) |
| ***D06F 37/00*** | (2006.01) |
| ***D06F 37/22*** | (2006.01) |

(52) U.S. Cl.
CPC ..... *D06F 37/267* (2013.01); *D06F 37/00* (2013.01); *D06F 37/22* (2013.01); *D06F 37/263* (2013.01); *D06F 37/264* (2013.01)

(58) Field of Classification Search
USPC ..... 68/139–142
See application file for complete search history.

(56) References Cited

U.S. PATENT DOCUMENTS

| | | | | |
|---|---|---|---|---|
| 2007/0113596 | A1* | 5/2007 | Kim et al. | 68/140 |
| 2008/0290234 | A1* | 11/2008 | Cho | 248/231.9 |

FOREIGN PATENT DOCUMENTS

| | | | |
|---|---|---|---|
| CN | 101046046 | A | 10/2007 |
| EP | 1 029 963 | A2 | 8/2000 |
| EP | 1 433 890 | A2 | 6/2004 |
| EP | 1 433 891 | A2 | 6/2004 |

(Continued)

OTHER PUBLICATIONS

Machine translation of KR 1020060009081 A, dated Jan. 2006.*

(Continued)

*Primary Examiner* — Joseph L Perrin
(74) *Attorney, Agent, or Firm* — Ked & Associates, LLP

(57) ABSTRACT

The present application relates to a laundry machine for washing laundry, including a tub for holding washing water, the tub including at least one fastener for fastening and wiring a wire harness along an outside surface thereof, a drum in the tub for holding laundry, a rotation shaft connected to a rear surface of the drum, a tub back which forms a rear side of the tub and through which the rotation shaft passes, a bearing housing for supporting the rotation shaft, a rear gasket connected between the tub and the tub back, and a suspension unit for supporting the bearing housing.

18 Claims, 6 Drawing Sheets

(56) References Cited

FOREIGN PATENT DOCUMENTS

| | | | | |
|---|---|---|---|---|
| EP | 1 605 088 | A2 | | 12/2005 |
| EP | 1 669 489 | A1 | | 6/2006 |
| JP | 09099196 | A | * | 4/1997 |
| KR | 1020060009081 | A | * | 1/2006 |
| KR | 10-2007-0015307 | A | | 2/2007 |

OTHER PUBLICATIONS

European Search Report dated Jul. 31, 2012 issued in Application No. 09 83 6429.
International Search Report and Written Opinion dated Oct. 11, 2011 issued in Application No. PCT/KR2009/008005.
International Search Report dated Oct. 11, 2010.

* cited by examiner

LAUNDRY MACHINE

TECHNICAL FIELD

The present invention relates to laundry machines, and more particularly, to a laundry machine in which a position of a harness wire in the laundry machine and a structure for securing the harness wire are improved while increasing a capacity thereof.

BACKGROUND ART

In general, the laundry machine removes various kinds of contaminants from clothes and beddings by using a softening action of detergent, friction of water flow and impacts applied to laundry caused by rotation of a pulsator or a drum. Current full automatic laundry machine carries out a series of courses of washing, rinsing, spinning, and so on automatically without intermittent handling of a user.

It is a current trend that demands for the drum type washing machine increase gradually, which, not only enables to reduce a total height, but also does not cause problems of entangling and crumpling of the laundry compared to a pulsator type laundry machine in which a washing tub rotates in an upright state.

A structure of the drum type washing machine will be described briefly. The drum type washing machine is provided with a body cabinet which forms an exterior of the drum type washing machine, a tub in the body cabinet supported by dampers and springs for holding washing water, and a cylindrical drum in the tub for placing the laundry therein, wherein the drum has driving power applied thereto by a driving unit for washing the laundry placed therein.

The drum type washing machine inevitably causes vibration due to rotation force of the drum, eccentricity of the laundry, and the like at the time the drum rotates for washing or spinning the laundry introduced to the drum, and the vibration caused by the rotation of the drum is transmitted to an outside of the drum type washing machine through the tub and the cabinet.

Consequently, in order to prevent the vibration from transmitting to the cabinet from the drum through the tub, springs and dampers are provided between the tub and the cabinet for buffering and damping the vibration of the tub, without fail.

In the meantime, the drum type washing machine is mostly installed, not independently, but in conformity with an existing installation environment (for an example, a sink environment or a built-in environment). Therefore, it is required that a size of the drum type washing machine is limited to the installation environment.

Thus, because change of an inside structure of the drum type washing machine is limited by the spring and damper which are provided for damping the vibration between the tub and the cabinet, and the installation environment of the drum type washing machine is limited, change of the size of the drum type washing machine itself is limited.

In the meantime, currently, in order to increase an amount of washing and user's convenience, many researches and developments are undergoing for increasing a washing capacity of the laundry machine. However, above limitations impose many difficulties on the increasing of the size of the tub for increasing the washing capacity in an existing drum type washing machine structure.

Consequently, a variety of structures of laundry machines are being developed for increasing the washing capacity.

DISCLOSURE

Technical Problem

To solve the problems, an object of the present invention is to provide a drum type washing machine of a new structure in which a drum supporting structure is completely different from a related art structure. In detail, a drum type washing machine of a new structure is provided in which, different from the related art, vibration of the drum transmits, not to the tub, but is buffered and supported as it is.

To solve the problems, another object of the present invention is to provide a drum type washing machine in which a position of a harness wire in the laundry machine and a structure for securing the harness wire are improved while increasing a capacity thereof.

Technical Solution

To achieve these objects and other advantages and in accordance with the purpose of the invention, as embodied and broadly described herein, a laundry machine includes a tub for holding washing water, the tub including at least one fastening means for fastening and wiring a wire harness along an outside surface thereof, a drum in the tub for holding laundry, a rotation shaft connected to a rear surface of the drum, a tub back which forms a rear side of the tub and through which the rotation shaft passes, a bearing housing for supporting the rotation shaft, a rear gasket connected between the tub and the tub back, and a suspension unit for supporting the bearing housing.

Preferably, the tub has reinforcing ribs on an outside circumferential surface for reinforcing strength of the tub.

Preferably, the fastening means is an extension from the reinforcing rib.

Preferably, the fastening means includes a plurality of projection plates having a plurality of cable holes formed therein, and a cable tie for fastening the wire harness passed through the cable hole in the projection plate.

Preferably, the fastening means includes a nut projection having a nut hole, a holder for surrounding and holding the wire harness, and a screw member for fastening the nut projection to the holder.

Preferably, the fastening means includes hook projection projected from an outside surface of the tub to have a recess for placing the wire harness therein.

Preferably, the tub includes a tub front and a tub rear, and the fastening means is formed at a contact portion of the tub front or the tub rear.

Preferably, a plurality of the fastening means are arranged along a side surface of an outside side of the tub at fixed intervals.

Preferably, the fastening means includes a first fastening means projected from an outside surface of the tub, having a projection plate with a plurality of cable holes, and a cable tie passed through the cable holes to fasten the wire harness, a second fastening means projected from the outside surface of the tub, having a nut projection having a nut hole, a holder surrounding and fastening the wire harness, and a screw member for fastening the holder to the nut projection, and a third fastening means projected from the outside surface of the tub, having a hook projection having a recess for placing the wire harness therein.

Preferably, the tub back further includes a motor harness fastening portion for fastening a motor harness of the motor thereto.

Preferably, the motor harness fastening portion includes a recess formed at a rim portion which forms an outside circumferential surface of the tub back and a hole formed in the rim portion.

Preferably, the motor harness fastening portion includes a fastening boss projected from the tub back, a holder for holding the motor harness, and a fastener for fastening the holder to the fastening boss.

In the meantime, the laundry machine can have the tub fixedly mounted thereto, or supported by a flexible supporting structure, like suspension units. Or, the laundry machine can be supported in an extent intermediate between the supporting by the suspension and the fixed mounting.

That is, the tub can be supported flexibly in an extent similar to the suspension unit to be described later, or rigidly more than supporting with the suspension. For an example, the tub can be supported by the suspension, or by ones, such as rubber bushings, for providing a certain extent of flexibility to the tub even though the supporting is not flexible more than the suspension.

More examples in which the tub is supported rigidly more than the suspension unit as are follows;

First, at least a portion of the tub can be formed as one unit with the cabinet.

Second, the tub can be supported connected with screws, rivets, or rubber bushings, or supported secured with welding, adhesive sealing, or the like. In this case, those connection members have rigidity greater than the suspension unit with respect to up/down directions which are a major vibration direction of the drum.

The tub can have a shape enlarged within a space the tub is mounted therein as far as possible. That is, the tub can be enlarged close to a wall or a frame (for an example, left or right side plates of the cabinet) that limits a left/right direction size of the space at least in left/right directions (a direction perpendicular to a shaft direction of a rotation shaft in a horizontal direction). The tub can be fabricated as one unit with the left or right side wall of the cabinet.

Relatively, the tub can be formed closer to the wall or the frame than the drum in the left/right directions. For an example, the tub can be formed to be spaced from the wall or the frame less than 1.5 times of a space to the drum. In a state the tub is expanded in the left/right directions thus, the drum also can be enlarged in the left/right directions. The smaller left/right direction spaces between the tub and the drum, the drum can be enlarged the more. In reducing the left/right direction spaces of the tub and the drum, left/right vibration of the drum can be taken into account. The smaller the left/right direction vibration of the drum, a diameter of the drum can be the greater. Therefore, the suspension unit which dampens the vibration of the drum can be made to have left/right direction rigidity greater than other direction rigidity. For an example, the suspension unit can be made to have rigidity with respect to a left/right direction deformation the greatest compared to rigidity in other directions.

Different from the related art, the suspension unit can be directly connected to the bearing housing which supports the rotation shaft connected to the drum, without passed through the tub. That is, the bearing housing can include a supporting portion for supporting the rotation shaft and an extension extended therefrom, and the suspension unit can be fastened to the supporting portion or the extension of the bearing housing.

In this instance, the suspension unit can include a bracket extended in a shaft direction of the rotation shaft. And, the bracket can be extended forward toward the door.

In the meantime, the suspension unit can include at least two suspensions spaced in an axis direction of the rotation shaft.

The suspension unit can include a plurality of suspensions which are mounted under the rotation shaft for standably supporting an object of supporting (for an example, the drum). Or, the suspension unit can include a plurality of suspensions which are mounted over the rotation shaft for suspendably supporting an object of supporting. Those cases are of types in which the suspensions are provided only under or over the rotation shaft for supporting.

A center of gravity of a vibrating body including the drum, the rotation shaft, the bearing housing, and the motor can be positioned on a side where the motor is with reference to at least a length direction geometric center of the drum.

One of the suspensions can be positioned in front or rear of the center of gravity. Moreover, the suspensions can be mounted in front and rear of the center of gravity, respectively.

The tub can have a rear opening. A driving unit including the rotation shaft, the bearing housing, and the motor can be connected to the tub through a flexible member. The flexible member can be made to seal such that water does not leak through the rear opening of the tub, and to enable the driving unit to move relative to the tub. The flexible member may be of any material as far as the material can function as a sealing and is flexible, for an example, flexible member may be formed of a gasket material like the front gasket. In this case, for convenience's sake, the flexible member may be called as a rear gasket with reference to the front gasket. The rear gasket can be connected to the driving unit in a state the rear gasket is limited not to rotate at least in a rotation direction of the rotation shaft.

As an embodiment, the rear gasket can be connected to the rotation shaft directly, or to the extension of the bearing.

A portion of the driving unit positioned in front of a connection portion to the rear gasket so as to be vulnerable to exposure to the washing water in the tub can be made to be prevented from corrosion by the washing water. For an example, the portion may be coated, or a front surface thereof may be covered with an additional component (for an example, a tub back described later) of plastic. Parts of the driving unit formed of metal can be prevented from corrosion by preventing the parts from direct exposure to the water.

Along with this, different from the embodiment, the cabinet may not be included to the laundry machine. For an example, in a case of a built-in laundry machine, a space the laundry machine is to be installed therein may be provided, not by the cabinet, but by a wall structure. That is, the laundry machine can be fabricated in a shape which does not include the cabinet which forms an exterior, independently. However, in this case too, the front frame can be required for a front exterior.

Advantageous Effects

The present invention has following advantageous effects.

The laundry machine of the present invention can provide a drum type washing machine with a drum supporting structure completely different from the related art. Vibration does not transmit from the drum to the tub, and buffered effectively.

The improvement on a position of a harness wire in the laundry machine and a structure for securing the harness wire while increasing a capacity thereof permits to simplify and make harness wire wiring safe.

BEST MODE

Reference will now be made in detail to the specific embodiments of the present invention, examples of which are illustrated in the accompanying drawings.

In describing the present invention, names of elements are defined taking functions thereof into account. Therefore, it is required to understand that the names do not limit the elements technically. Moreover, the names of the elements may be called differently in this field of art.

Figure 1:
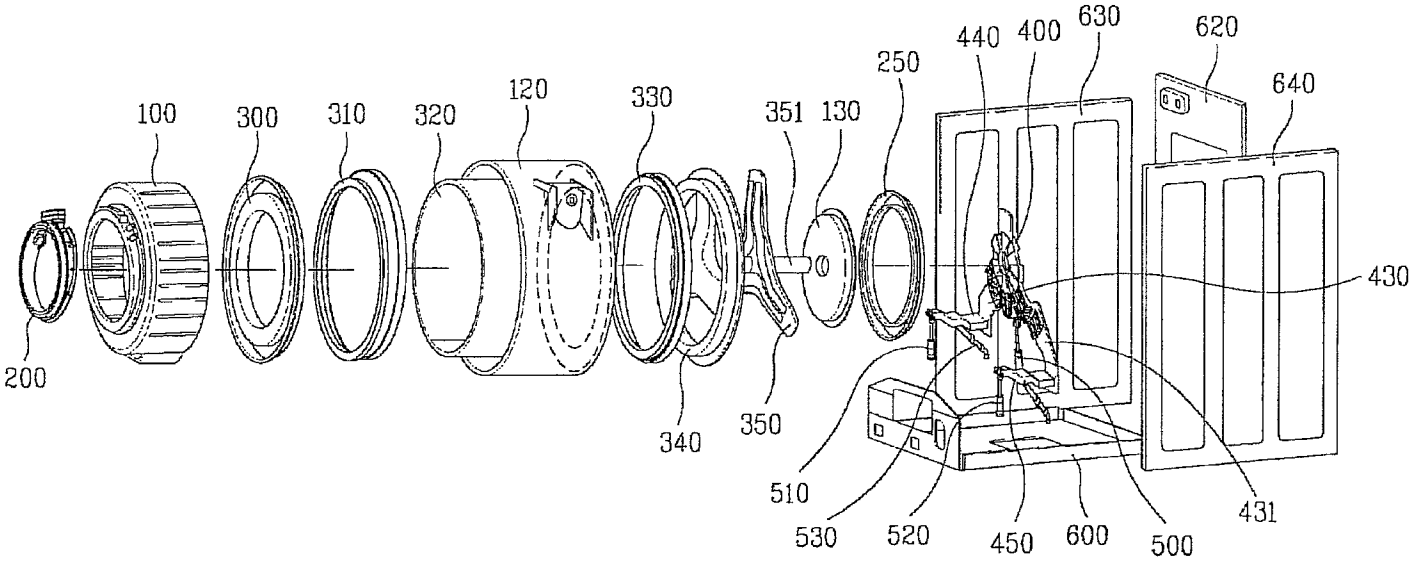
FIG. 1 illustrates an exploded perspective view of a laundry machine in accordance with a preferred embodiment of the present invention.

FIG. 1 illustrates an exploded perspective view of a laundry machine in accordance with a preferred embodiment of the present invention.

Referring to FIG. 1, the laundry machine has a tub fixedly secured to a cabinet. The tub includes a tub front 100 which forms a front portion thereof and a tub rear 120 which forms a rear portion thereof. The tub front 100 and the tub rear 120 are fastened together with screws for forming a space for placing a drum therein. The tub also includes a tub back 130 which forms a rear surface thereof. The tub back 130 is connected to the tub rear 120 with a rear gasket 250. The rear gasket 250 is formed of elastic material for preventing vibration from transmitting to the tub rear 120 from the tub back 130.

The tub rear 120 has a rear surface 128. The rear surface 128 of the tub rear 120, the tub back 130, and the rear gasket 250 form a rear wall surface of the tub. The rear gasket 250 is sealably connected to the tub back 130 and the tub rear 120 respectively for preventing the washing water from leaking from the tub. The tub back 130 vibrates together with the drum when the drum rotates. In order to prevent the tub back 130 from interfering with the tub rear 120 at the time the tub back 130 vibrates, the tub back 130 is spaced from the tub rear 120, adequately. Since the rear gasket 250 is formed of elastic material, the rear gasket 250 allows the tub back 130 to make relative motion without interference with the tub rear 120. The rear gasket 250 may have a corrugated portion 252 (See FIG. 4) which can be extended adequately for allowing the relative motion of the tub back 130.

A foreign matter getting in preventive member 200 is connected to a front of the tub front 100 for preventing foreign matters from entering between the tub and the drum. The foreign matter getting in preventive member 200 is formed of an elastic material, and fixedly mounted to the tub front 100. The foreign matter getting in preventive member 200 may be formed of a material the same with the rear gasket 250.

The drum includes a drum front 300, a drum center 320, and a drum back 340. Ball balancers 310 and 330 are mounted to a front portion and a rear portion of the drum, respectively. The drum back 340 is connected to a spider 350, and the spider 350 is connected to a rotation shaft 351. The drum rotates in the tub by rotation force transmitted thereto through the rotation shaft 351.

The rotation shaft 351 is passed through the tub back 130 and connected to the motor, directly. In detail, a rotor of the motor and the rotation shaft 351 are connected, directly. There is a bearing housing 400 coupled to the rear surface 128 of the tub back 130. The bearing housing 400 rotatably supports the rotation shaft 351 between the motor and the tub back 130.

A stator is fixedly mounted to the bearing housing 400. The rotor is positioned around the stator. As described before, the rotor is directly connected to the rotation shaft 351. The motor, being an outer rotor type motor, is connected to the rotation shaft 351, directly.

The bearing housing 400 is supported on a cabinet base 600 through a suspension unit. The suspension unit includes three vertical suspensions and two tilted suspensions for supporting in front/rear directions in tilted positions. The suspension unit is connected to the cabinet base 600, not fixedly perfectly, but to allow a certain extent of elastic deformation to allow the drum to move in front/rear and left/right directions.

*65 That is, the suspension unit is elastically secured to allow a certain extent of rotation of the suspension unit in front/rear and left/right directions with respect to a securing point at which the suspension unit is connected to the base. In order to make such elastic securing, the vertical suspensions may be mounted to the base 600 with rubber bushings disposed therebetween, respectively. Of the suspensions, it can be configured that the vertical suspensions elastically buffer vibration or the drum, and the tilted suspensions dampens the vibration. That is, it can be configured that, of a vibration system having springs and damping means, ones mounted in vertical positions serve as a spring and ones mounted in tilted positions serve as damping means.

The tub is fixedly mounted to the cabinet except the tub back 130, and the vibration of the drum is buffered and supported by the suspension unit. It can be said that supporting structures for the tub and the drum are separated from each other actually, such that the tub does not vibrate even if the drum vibrates.

Respective parts will be described in detail.

Figure 2:
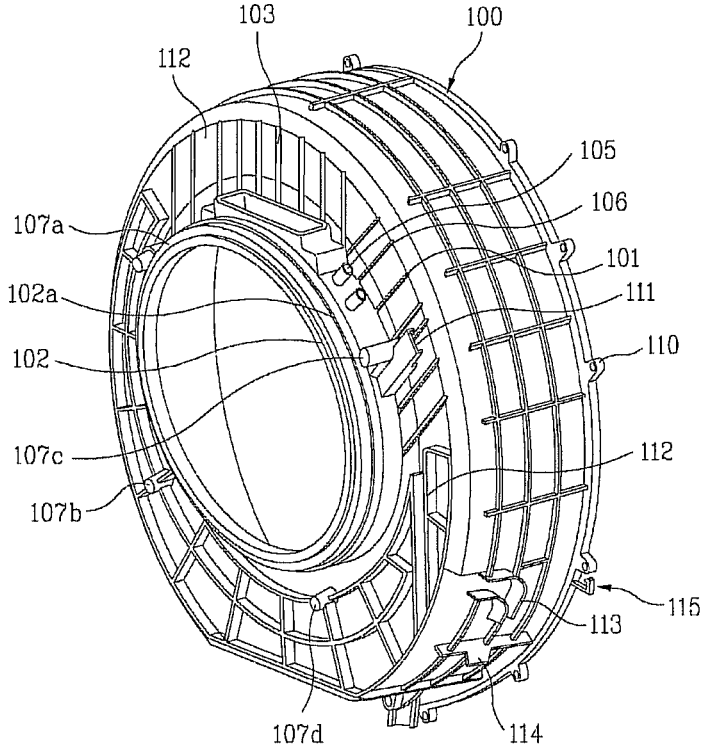
FIGS. 2 and 3 illustrate perspective views of tub fronts of a laundry machine in accordance with a preferred embodiment of the present invention, respectively.
Figure 3:
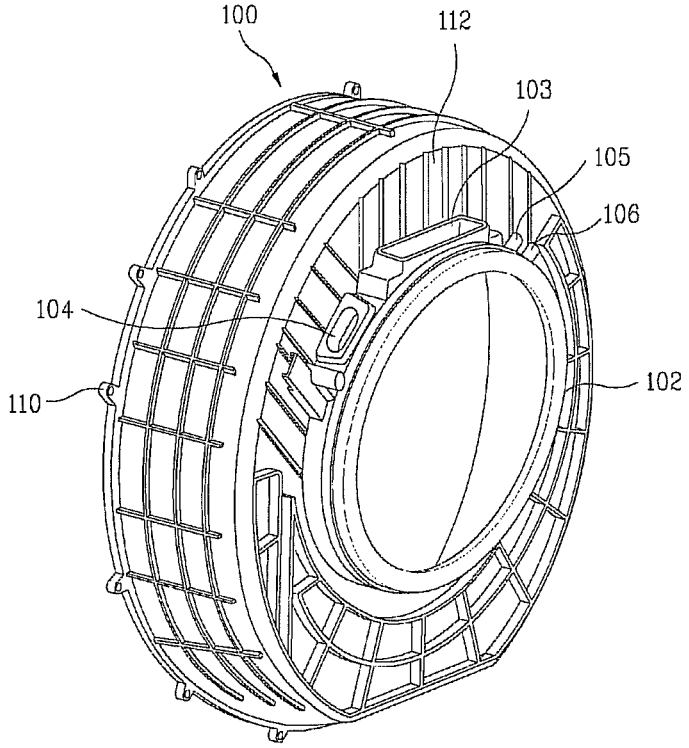

FIGS. 2 and 3 disclose the tub front 100. The tub front 100 has a donut shaped vertical front surface at a front side of a cylindrical surface which is a portion of a sidewall of the tub. A rear side of the cylindrical surface is opened, and has a plurality of fastening holes 110. The fastening holes 110 are fastened to fastening holes 127 (See FIG. 4) in the tub rear 120 matched thereto, respectively.

*69A rim portion 101 is extended forward from an inside circumferential surface of a front surface of the tub front 100.

The rim portion 101 has a width which becomes the smaller as the rim portion 101 goes from an upper side to a lower side the more. At a lower side of a lower edge of the front surface, there may not be the rim portion 101 formed thereon, actually.

The rim portion 101 has a water supply hole 104, a hot air inlet 103 to be used for drying, a circulating water inlet 106 for inlet of washing water circulated by a circulating pump, and a steam inlet 105 for introduction of steam.

Since the laundry machine of the present invention has vibration of the tub reduced significantly, connection of a water supply structure, such as the water supply hose for supplying washing water, a structure for drying, such as drying duct, a structure for supplying steam, a structure for supplying the circulating water, and so on can be held in position, securely.

The hot air inlet 103 is an upward rectangular shaped extension from the rim portion 101, substantially. The hot air inlet 103 is required for a washing and drying machine, and may not be required for a washing machine which has no drying function.

Since the water supply hole 104 and so on are formed in the front portion of the tub front 100, supply of the washing water and so on are made at the front side of the tub.

The water supply hole 104 and so on can be positioned in front of a front end of the drum which is housed in the tub. Accordingly, the washing water and so on can be introduced to the drum directly through a drum opening provided for laundry in/out. Since fluids which are supplied for treating the laundry, such as the washing water and so on, can be introduced to the drum directly, effective treatment of the laundry is possible. Moreover, in a case detergent is supplied together with the washing water which is supplied through detergent box, if the detergent is introduced to the drum directly, consumption of the detergent can be reduced, enabling to reduce an amount of the washing water, accordingly. And, a problem of contamination of a bottom of the tub by deposition of detergent sediments can be reduced. Furthermore, the water supply from the front of the tub can have an effect of washing door glass (not shown).

Even if the hot air is supplied from the front of the tub, if the hot air is supplied through a vertical surface of the tub front 100, since a flow of the hot air undergoes two times of bending to form a "shape (a "shaped complicate flow is formed as the hot air introduced into the tub is bent downward at a front of the tub and bent forward of the tub again), the flow of the hot air can be poor. However, if the hot air inlet 103 is formed in the rim portion 101 of the tub front 100, the flow of the hot air can be smooth since the hot air flow is required to bend only once, vertically.

The water supply holes 104 and so on are positioned above a center point of the drum. The washing water and so on are supplied to the drum from an upper side of the front of the drum. If, different from this, it is required to supply the washing water and so on to the drum from a lower side of the front of the drum, the rim portion 101 of the tub front 100 can be formed at the lower side of the front surface, accordingly. If it is required to supply the washing water and so on to the drum, not from the upper or lower side, but from a left or right side of the front of the drum, the rim portion 101 of the tub front 100 can be formed in the vicinity of a center portion 131 of an inside edge of the front surface, accordingly. That is, a shape of the rim portion 101 can vary with a direction of supply of the fluids.

In a front edge of the rim portion 101, there is a coupling portion 102 for coupling the foreign matter getting in preventive member 200 thereto. The coupling portion 102 is a forward extension from a front end of the rim portion 101 to form a small cylindrical surface, substantially. The small cylindrical surface has a rib 102*a* formed on an outside circumferential surface.

The tub front 100 has a plurality of reinforcing ribs on an outside surface thereof for reinforcing strength of the tub front 100, additionally. The plurality of reinforcing ribs are formed in a circumferential direction of a body of the cylindrical tub front 100.

Though the reinforcing ribs are formed for reinforcing the strength of the tub front 100, shapes of the reinforcing ribs can be changed for performing other functions additionally. For an example, the reinforcing ribs can be formed to form a washing water moving path for limiting a moving path of the washing water leaked at the time the washing water leaks.

The tub front 100 has a plurality of reinforcing ribs on an outside surface of a front surface thereof. In the meantime, the reinforcing ribs on the front surface are formed in circular and radial directions. The reinforcing ribs on the front surface can vary with parts formed on the rim portion 101.

That is, the reinforcing ribs on the front surface can vary with a moving direction of a slide core of a mold by using which the tub front 100 is injection molded. For an example, in cases of parts of the hot air inlet 103, and the steam inlet 105 (or the circulating water inlet 106), the reinforcing ribs can be formed extended in a moving direction of the slide mold core to be moved at the time the hot air inlet 103, and the steam inlet 105 (or the circulating water inlet 106) are formed.

Though the reinforcing ribs are formed for reinforcing strength of the tub front 100, shapes of the reinforcing ribs can be changed for performing other function, additionally. That is, the reinforcing ribs can be formed to fasten and guide various kinds of wire harnesses (not shown) adjacent to the tub front 100. In those cases, the reinforcing rib can be extended in a direction different from other reinforcing ribs, or projected more. For an example, of the reinforcing ribs on the front surface, there may be a plurality of fastening means 114 and 115 formed at fixed intervals for guiding the wire harnesses to form a harness fastening path.

The foreign matter getting in preventive member 200 is coupled to the coupling portion 102 as the coupling portion 102 is placed in the foreign matter getting in preventive member 200. Accordingly, the foreign matter getting in preventive member 200 has a groove (not shown) for placing the small cylindrical surface having the rib 102*a* therein.

The tub front 100 is fixedly connected to the cabinet front (not shown). For this fixed connection of the tub front 100, fastening bosses 107*a*, 107*b*, 107*c* and 107*d* are formed on the front surface of the tub front 100 around the rim portion 101, substantially. After positioning the cabinet front (not shown) in a state the tub front 100 is mounted, the cabinet front (not shown) is fastened to the tub front 100 by fastening screws in a rear direction.

In the embodiment, the water inlet 104, the hot air inlet 104, the circulating water inlet 106, and the steam inlet 104 and so on are formed on an upper side of the rim portion 101. Accordingly, it is preferable that positions at which the fastening bosses 107*a* and the 107*c* are formed are more or less wider than positions at which the fastening bosses 107*b* and the 107*d* are formed. Moreover, the fastening boss 107*c* on one side may have a fastening recess 111 for fastening the wire harness or a washing water pipeline thereto, additionally. Moreover, some of the reinforcing ribs on the front surface may have guide ribs 112 spaced and extended by predetermined distances to form the fastening path of the wire harness or the washing water pipeline, additionally.

The steam inlet 105 can be connected to a steam hose. The steam inlet 105 has a steam guide 105*a* for guiding the steam introduced thereto to an inside of the drum. The circulating water inlet 106 has a circulating water guide 106*a* for guiding the circulating water introduced to the circulating water inlet 106 to the inside of the drum. The steam inlet 105, the circulating water inlet 106, the steam guide 105*a* and the circulating water guide 106*a* are formed as one unit with the tub front 100. The tub front 100 of plastic is injection molded together with the steam inlet 105 and so on as portions of the tub front 100.

The tub front 100 is coupled to the tub rear 120 to form a space for housing the drum. The tub front 100 and the tub rear 120 are fastened with screws. For this screw fastening, the tub front 100 has a plurality of screw fastening holes 110 formed along a circumference of a rear portion thereof.

Figure 4:
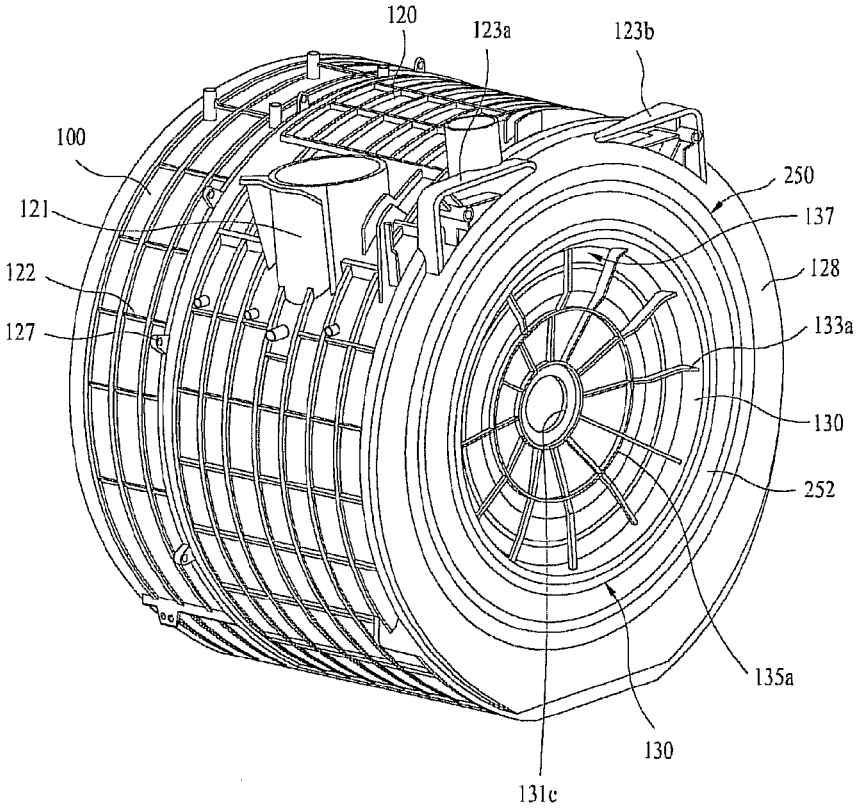
FIG. 4 illustrate a rear perspective view of a tub rear of a laundry machine in accordance with a preferred embodiment of the present invention.

FIG. 4 illustrates the tub front 100, the tub rear 120, the tub back 130, and the rear gasket 250 assembled together.

The tub rear 120 is coupled to the tub front 100 to form a space in which the drum rotates. The tub rear 120 is cylindrical to have hollow to surround the drum, and has an opened front and the donut shaped rear surface 128. The front is sealably coupled to the tub front 100. The rear surface 128 of the tub rear 120 has a diameter adequately greater than the outside diameter of the tub back 130, so that a gap is formed enough to prevent the tub back 130 from interfering with the rear surface 128 of the tub rear 120 even if the tub back 130 vibrates. In the gap, i.e., between the rear surface 128 of the tub rear 120 and the tub back 130, there is the rear gasket 250 connected. The rear gasket 250 seals between the rear surface 128 of the tub rear 120 and the tub back 130. The rear gasket 250 has a corrugated portion 252 having an adequate flexibility for not interfering with the vibration of the tub back 130.

The tub rear 120 has a hot air outlet 121 on one side for the washing and drying machine. It is natural that the hot air outlet 121 is not required if the laundry machine is not the washing and drying machine, but a washing machine only for washing.

Moreover, the tub rear 120 has a plurality of reinforcing ribs formed on an outside circumferential surface of a body of the tub rear 120 for reinforcing strength of the tub front 100, additionally. A plurality of the reinforcing ribs are formed in a circumferential direction of the body of the tub rear 120.

Though the reinforcing ribs are formed for reinforcing strength of the tub rear 120, shapes of the reinforcing ribs can be changed for performing other functions, additionally. For an example, the reinforcing ribs can be formed to form a moving path of the washing water to limit a moving path of the washing water leaked at the time of washing water leakage.

Moreover, of the reinforcing ribs on the front surface, there may be a plurality of fastening means 116 for fastening and guiding the wire harnesses adjacent to the tub rear 120. In this case, the fastening means 116 can be extended in a direction different from other reinforcing ribs or projected more.

In the meantime, the plurality of fastening means 114, 115, and 116 formed on the tub front 100 and the tub rear 120 will be described in detail with reference to attached drawings after basic configuration of the laundry machine of the present invention is described.

In the meantime, under the tub front 100 and the tub rear 120, there is an additional structure for fixedly securing the tub.

The tub back 130 has a pass through hole 131*c* formed at a center for passing the rotation shaft 351 to rotate the drum. On an outer side of the pass through hole 131*c*, there are a plurality of radial direction ribs 133*a* projected in a radial direction and circumferential direction for reinforcing strength of the tub back 130. Along a circumferential direction of the radial direction ribs 133*a*, there are a plurality of fastening bosses 135*a* for fastening the bearing housing 400 thereto.

Figure 5:
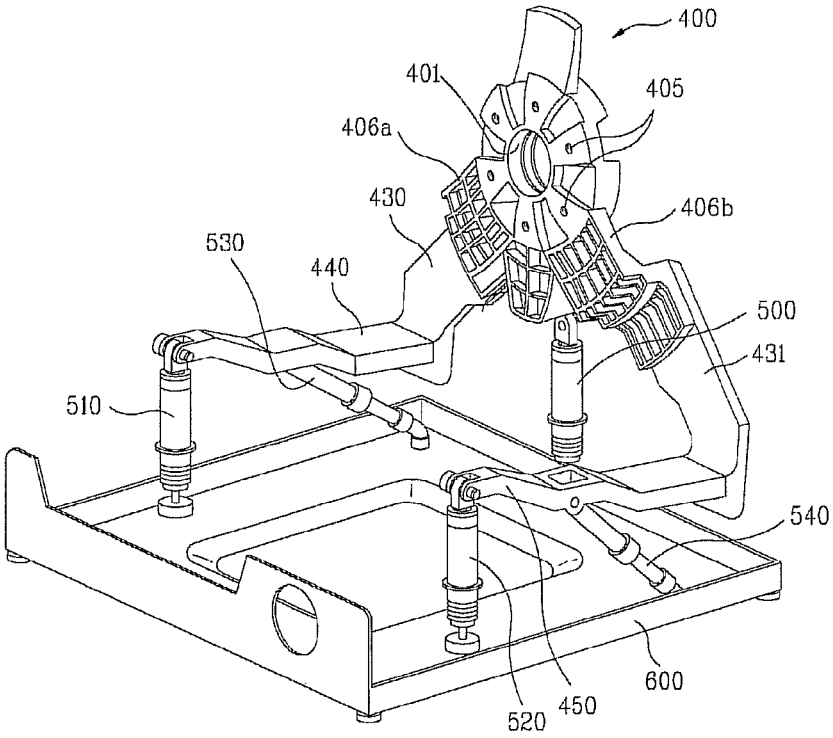
FIG. 5 illustrates a suspension of a laundry machine in accordance with a preferred embodiment of the present invention.
Figure 6:
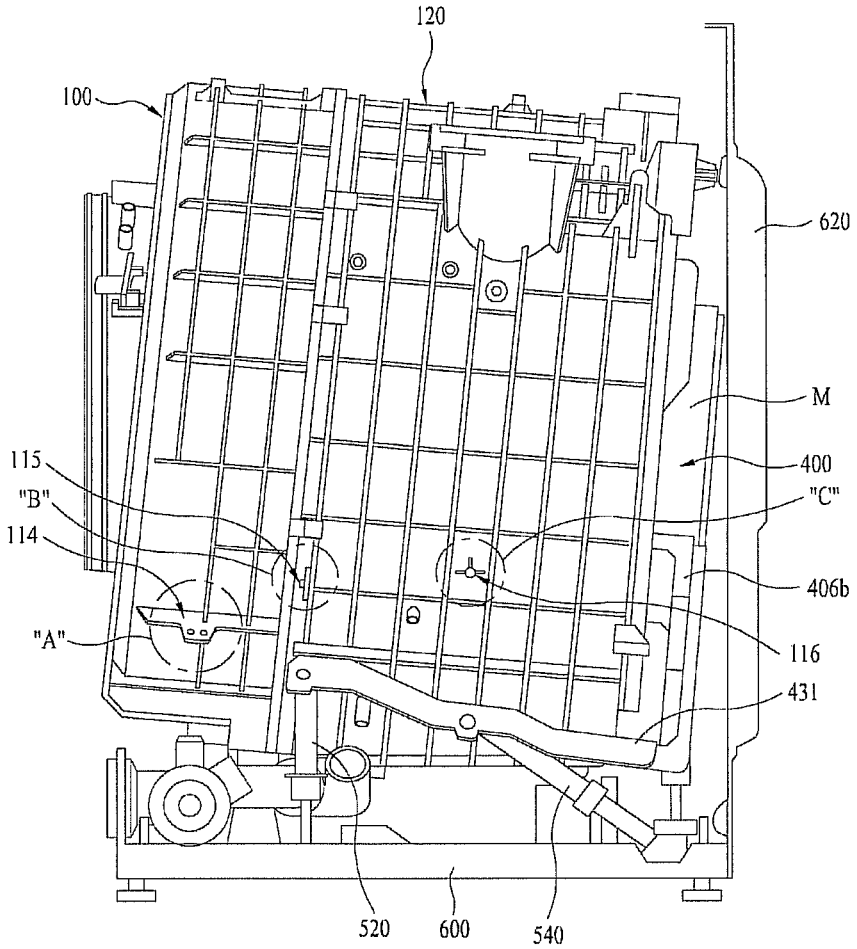
FIG. 6 illustrates a side view of an assembly of a tub and a suspension of a laundry machine in accordance with a preferred embodiment of the present invention.

FIG. 5 illustrates the suspension unit mounted on the base 600. FIG. 6 illustrates assembly of the tub 100 and 120, the bearing housing 400, and the suspension unit.

The suspension unit includes the bearing housing 400, a first weight 431, a second weight 430, a first suspension bracket 450, and a second suspension bracket 440.

The bearing housing 400 has a rotation shaft hole 401 at a center for passing the rotation shaft 351. The rotation shaft hole 401 have one pair of bearings 404 placed in a front end and a rear end thereof, respectively. The rotation shaft 351 is rotatably supported by the bearings 404.

The rotation shaft hole 401 has a plurality of tub back fastening holes 405 formed around the rotation shaft hole 401 matched to the pass through holes in the tub back 130. In rear of the bearing housing 400, there is a motor mounting portion (not shown).

There is a wire harness fastening portion 117 on an outside circumference of the tub back 130 for fastening the wire harness connected to the motor mounted to the bearing housing 400 thereto, additionally. Since the motor is configured to vibrate together with the bearing housing 400, the wire harness fastening portion 117 is required to have firm fastening different from the related art configuration. The motor harness fastening portion 117 will be described in detail with reference to attached drawings after basic configuration of the laundry machine of the present invention is described.

The bearing housing 400 is coupled to the tub back 130 with additional fastening bodies which pass through the pass through holes 405. Between the bearing housing 400 and the tub back 130 coupled thus, there is a water seal (not shown) for maintaining sealing between the bearing housing 400 and the tub back.

Extended in a radial direction of left and right directions from the bearing housing 400, there are a first extension 406*a* and a second extension 406*b* The first extension 406*a* and the second extension 406*b* have the first weight 431 and the second weight 430 connected thereto, respectively. The first weight 431 and the second weight 430 have the first suspension bracket 450 and the second suspension bracket 440 connected thereto, respectivley.

The first extension 406*a* and the second extension 406*b*, the first weight 431 and the second weight 430, and the first suspension bracket 450 and the second suspension bracket 440 are symmetry to each other, respectively. The first and second weights 431 and 430 serve as balancer in a case the drum holds laundry, and mass in a vibration system in which the drum vibrates.

The suspension unit can include vertical suspensions for buffering in a vertical direction and front/rear direction suspensions for buffering in front/rear directions. One of the vertical suspensions can be arranged on a rear side of the base, and two of the vertical suspensions can be arranged on a front side of the base on left and right sides of a center of the base, respectively. Two suspensions can be arranged on left and right sides tilted in a front/rear direction.

The suspension unit can include a first cylinder spring 520, a second cylinder spring 510, a third cylinder spring 500, a first cylinder damper 540, and a second cylinder damper 530.

The cylinder spring is mounted between a cylinder and a piston. Owing to the cylinder and the piston, a length of the cylinder spring makes stable variation at the time of buffering. The cylinder is connected to the suspension bracket and the piston is connected to the base. A cylinder damper provides a damping effect as the piston moves in the cylinder.

The first cylinder spring 520 is connected between the first suspension bracket 450 and the base 600. The second cylinder spring 510 is connected between the second suspension bracket 440 and the base 600. The third cylinder spring 500 is connected between the bearing housing 400 and the base 600, directly. The cylinder springs buffer and support at one point on the rear side and two points on the left and right sides of the front side.

The first cylinder damper 540 is mounted tilted between the first suspension bracket 450 and the rear side of the base, and the second cylinder damper 530 is mounted tilted between the second suspension bracket 440 and the rear side of the base.

The third cylinder spring 500 is arranged at a center of the rear side, and the first cylinder spring 520 and the second cylinder spring 510 are arranged on left and right sides of the front side, respectively. The first cylinder damper 540 and the second cylinder damper 530 are positioned between a rear side of the third cylinder spring 500 and a front side of the first cylinder spring 520 and the second cylinder spring 510. Those are symmetry in left/right directions. The cylinder springs are connected to the base 600 with rubber bushings disposed therebetween, respectively.

In the meantime, the laundry machine of the present invention includes a main controller (not shown) for operation and control of respective elements thereof. The main controller is a unit for receiving an order from the user from a control panel (which is a user interface) and controlling operation of the laundry machine, such as operation of the drum according to the order. The main controller and respective electric components are connected with separate electric wires for power supply, and control signal transmission. In the meantime, the electric wires are fabricated separately and mounted in the laundry machine in bundles. In general, the bundles of electric wires are called as wire harness.

In the meantime, the laundry machine of the present invention has a structure for fastening the wire harness thereto, formed completely different from the related art.

That is, the related art laundry machine is constructed such that the drum and the tub vibrate together. Therefore, since the tub vibrates, fastening the wire harness along the tub is very difficult and causes many problems in maintenance. Consequently, in the related art laundry machine, the wire harness is mostly fastened along an inside wall of the cabinet with additional fastening members. That is, it is required to extend a length of the wire harness unnecessarily, and a wiring structure also becomes complicate. Moreover, since the wire harness is required to fasten after the cabinet is mounted, workability becomes very poor.

However, in the laundry machine of the present invention, transmission of vibration from the drum to the tub is blocked comparatively. Therefore, since there is no vibration of the tub comparatively, the wire harness can be fastened along an outside surface of the tub. In this case, the length of the wire harness can be shortened, and assembly of the laundry machine can becomes easy by mounting the cabinet after the wire harness is fastened.

The structure for fastening the wire harness will be described in detail, with reference to the attached drawings FIGS. 7 to 11.

Figure 7:
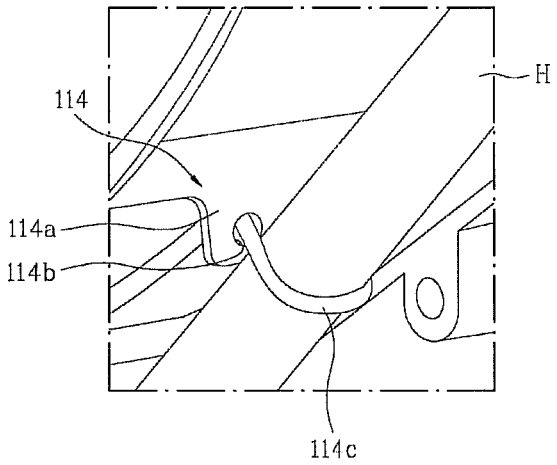
FIG. 7 illustrates a perspective enlarged view of "A" part in FIG. 6.
Figure 8:
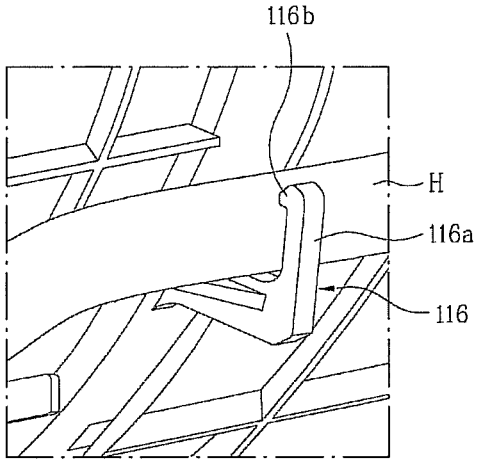
FIG. 8 illustrates a perspective enlarged view of "B" part in FIG. 6.
Figure 9:
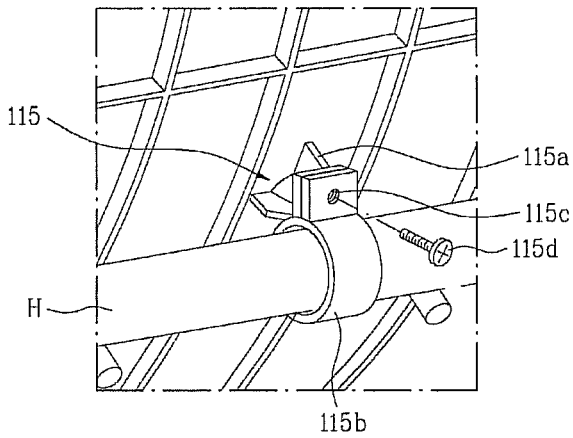
FIG. 9 illustrates a perspective enlarged view of "C" part in FIG. 6.
Figure 10:
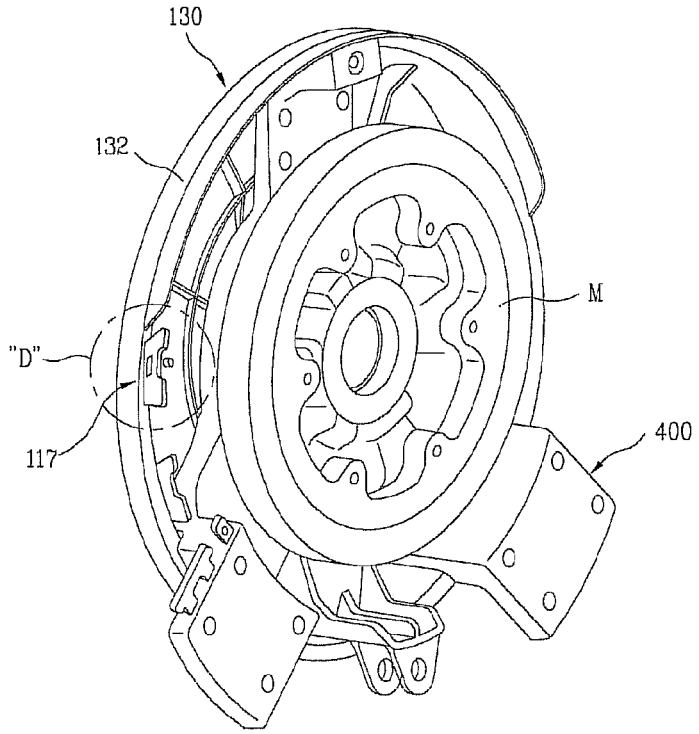
FIG. 10 illustrates a perspective view of an assembly of a tub back, a bearing housing, and a motor of a laundry machine in accordance with a preferred embodiment of the present invention.
Figure 11:
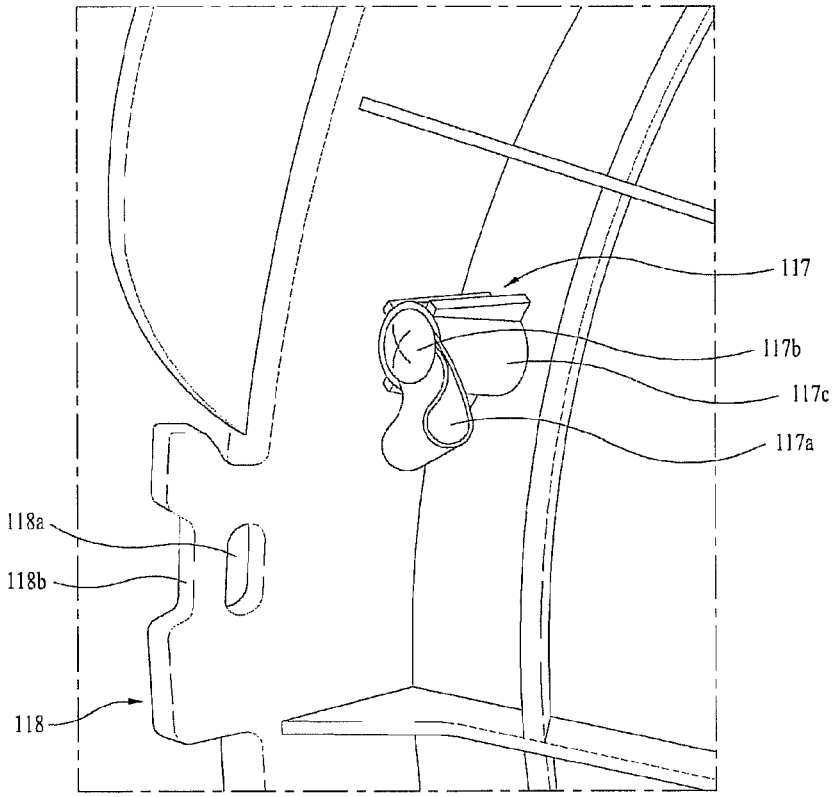
FIG. 11 illustrates a perspective enlarged view of "D" part in FIG. 10.

FIG. 7 illustrates a perspective enlarged view of "A" part in FIG. 6, FIG. 8 illustrates a perspective enlarged view of "B" part in FIG. 6, FIG. 9 illustrates a perspective enlarged view of "C" part in FIG. 6, FIG. 10 illustrates a perspective view of an assembly of a tub back, a bearing housing, and a motor of a laundry machine in accordance with a preferred embodiment of the present invention, and FIG. 11 illustrates a perspective enlarged view of "D" part in FIG. 10.

Referring to FIG. 6, a plurality of fastening means 114, 115, and 116 are provided on outside circumferential surfaces of the tub front 100 and the tub back 120. The fastening means 114, 115, and 116 are shown as exemplary for describing respective structures. Therefore, the fastening means 114, 115, and 116 do not limit numbers, positions, order, and so on, and the numbers, positions, order, and so on can vary as necessary.

The first fastening means 114 will be described. As shown in FIGS. 6 and 7, the first fastening means can be projected from an outside circumferential surface of the tub front 100. Preferably, the first fastening means can be an extension from a portion of the reinforcing rib projected from the outside surface of the tub front 100 for reinforcing strength of the tub front 100.

The first fastening means 114 includes a projection plate 114*a* which is an extension from the reinforcing rib of the tub front 100, one or more than one cable holes 114*b* in the projection plate 114*a*, and a cable tie 114*c* placed in the cable holes 114*b* to fasten the wire harness.

The projection plate 114*a* is a plate which is a length of extension from the reinforcing rib of the tub front 100. The cable tie 114*c* has one ends pass through the at least one cable hole 114*c* in the projection plate 114*a*, surround and tie the wire harness H and are connected at the other ends to fasten the wire harness H.

The first fastening means 114 can be formed extended from the reinforcing rib on the tub front 100, the tub rear 120, the tub back 130, and so on. Or, without the reinforcing rib on the tub front 100, the tub rear 120, the tub back 130, and so on, the first fastening means 114*a* can be formed as a separate projection.

The second fastening means 116 will be described. As shown in FIGS. 6 and 8, the second fastening means 116 can be formed projected from an edge of the tub front 100 or the tub rear 120. Preferably, the second fastening means 116 can be formed one of coupling surfaces of the tub front 100 and the tub rear 120.

As shown, the second fastening means 116 is a hook projection 116*a* projected from a reinforcing rib on an outside circumferential surface of a contact portion of the tub front 100 or the tub rear 120.

The hook projection 116*a* has an "L" shaped bent portion for placing the wire harness H therein. The wire harness H is placed in, and fastened to the bent portion. The hook projection 116*a* has a holding step 116*b* at an end for preventing the wire harness H from falling off the hook projection 116*a*. The holding step 116*b* can improve fastening force of the wire harness H placed therein.

The second fastening means 116 can be formed extended from the reinforcing rib on the tub front 100, and the tub rear 120. Or, without the reinforcing rib on the tub front 100, the tub rear 120, the hook projection 116*a* can be formed as a separate projection.

The third fastening means 115 will be described. As shown in FIGS. 6 and 9, the third fastening means 115 can be formed projected from a predetermined portion of an edge of the tub rear 120. It is preferable that the third fastening means 115 is used for fastening the wire harness at a comparatively large space.

The third fastening means 115 includes a nut projection 115*a* formed on an outside surface of the tub rear 120, a holder 115*b* for surrounding and holding the wire harness H, and a screw member 115*d* for passing through the holder 115*b* and placed in the nut projection 115*a*.

The nut projection 115*a* is projected from an outside surface of the tub rear 120 and has a screw hole 115*c* for placing the screw member 115*d* therein and fastening the screw member 115*d* thereto as the screw member 115*d* is rotated therein. The holder 115*b* is configured to surround the wire harness, and is formed of a flexible material for this purpose.

The nut projection 115*a* can be formed in association with the reinforcing rib. Or, different from this, the nut projection 115*a* can be formed from a flat portion of the tub rear 120 regardless of the reinforcing rib. Or, formation of the nut projection 115*a* at the tub rear 120 is described, the nut projection 115*a* can be formed at the tub front 100.

In the meantime, it is preferable that the fastening means 114, 115, and 116 are arranged at fixed intervals along an outside surface of the tub. By arranging the fastening means 114, 115, and 116 along the outside surface of the tub, a length of the wire harness can be shortened.

The motor harness fastening portion 117 formed at the tub back 130 will be described in detail with reference to the attached drawings FIGS. 10 and 11. As shown, the motor harness fastening portion 117 is formed on an outside circumferential surface of the tub back 130 coupled to the bearing housing 400. The motor harness fastening portion 117 is formed at the rim portion 132 of the tub back 130 for fastening a motor harness (not shown) for supplying power and providing control signals to the motor coupled to the bearing housing 400.

In general, a washing machine motor uses three phases. Therefore, three lines are required for motor control. Moreover, many lines, such as lines for grounding, and lines for hole sensor, are required. It is necessary that the lines are connected to the control unit of the washing machine, with the lines bound into one. And, it is preferable that the lines are fastened intermittently. For this, the motor harness is required for connecting the lines between the control unit and the motor, and a structure for fastening the motor harness is required.

The motor harness fastening portion 117 may have a recess 118*b* at middle or one side thereof for fastening the motor harness thereto. The motor harness fastening portion 117 may have a hole 118*a* formed therein for fastening the lines connected to the motor harness with fastener, such as a cable tie, through the hole 118*a*

The motor harness fastening portion 117 can be formed as one unit with the tub back 130. That is, by forming the motor harness fastening portion 117 at the time of injection molding of the tub back 130, no additional structure for mounting the motor harness is required.

Moreover, on a rear surface of the tub back 130, a motor harness fastening boss 117*c* may be formed for making movement of the motor harness at a rear side of the tub back small as far as possible. The motor harness fastening boss 117*c* is provided for preventing the motor harness from moving or sagging to interfere with the rotor of the motor by the vibration. The motor harness fastening boss 117*c* may include a flexible holder 117*a* fastened with a screw 117*b*.

According to the laundry machine of the present invention, since the tub is fixedly secured to the cabinet directly not to make any movement, a diameter of the tub can be made greater, thereby permitting to enlarge volumes of the tub and the drum, substantially.

The supporting of the drum only at one side permits to enlarge the volume of the drum further compared to a system in which the drum is supported by opposite sides, and to improve productivity since a number of components are reduced as much.

Moreover, since the tub is fixedly secured to the cabinet, making not only the tub to shake in a case vibration or an impact is applied to the tub which is assembled as one unit with the cabinet, rigidity of the tub increases since weight of the cabinet is added to the tub, and an overall vibration characteristic of the drum type washing machine is improved.

The invention claimed is:

1. A laundry machine comprising:

a tub for holding washing water, the tub including at least one fastening means for fastening and wiring a wire harness along an outside surface thereof;

a drum in the tub for holding laundry;

a rotation shaft connected to a rear surface of the drum;

a tub back which forms a rear side of the tub and through which the rotation shaft passes;

a bearing housing for supporting the rotation shaft;

a rear gasket connected between the tub and the tub back; and a suspension unit for supporting the bearing housing, wherein the tub back further includes a motor harness fastening portion for fastening a motor harness of the motor thereto, and wherein the motor harness fastening portion includes a fastening boss projected from the tub back, a holder for holding the motor harness, and a fastener for fastening the holder to the fastening boss.

2. The laundry machine as claimed in claim 1, wherein the tub has reinforcing ribs on an outside circumferential surface for reinforcing strength of the tub.

3. The laundry machine as claimed in claim 2, wherein the fastening means is an extension from the reinforcing rib.

4. The laundry machine as claimed in claim 1, wherein the fastening means includes a projection plate having a plurality of cable holes formed therein, and a cable tie for fastening the wire harness passed through the cable hole in the projection plate.

5. The laundry machine as claimed in claim 1, wherein the fastening means includes a nut projection having a nut hole, a holder for surrounding and holding the wire harness, and a screw member for fastening the nut projection to the holder.

6. The laundry machine as claimed in claim 1, wherein the fastening means includes hook projection projected from an outside surface of the tub to have a recess for placing the wire harness therein.

7. The laundry machine as claimed in claim 6, wherein the tub includes a tub front and a tub rear, and the fastening means is formed at a contact portion of the tub front or the tub rear.

8. The laundry machine as claimed in claim 1, wherein a plurality of the fastening means are arranged along a side surface of an outside side of the tub at fixed intervals.

9. The laundry machine as claimed in claim 1, wherein the fastening means includes;

a first fastening means projected from an outside surface of the tub, having a projection plate with a plurality of cable holes, and a cable tie passed through the cable holes to fasten the wire harness, a second fastening means projected from the outside surface of the tub, having a nut projection having a nut hole, a holder surrounding and fastening the wire harness, and a screw member for fastening the holder to the nut projection, and a third fastening means projected from the outside surface of the tub, having a hook projection having a recess for placing the wire harness therein.

10. A laundry machine comprising:

a tub for holding washing water, the tub including at least one fastening means for fastening and wiring a wire harness along an outside surface thereof;

a drum in the tub for holding laundry;

a rotation shaft connected to a rear surface of the drum;

a tub back which forms a rear side of the tub and through which the rotation shaft passes;

a bearing housing for supporting the rotation shaft;

a rear gasket connected between the tub and the tub back; and a suspension unit for supporting the bearing housing, wherein the tub back further includes a motor harness fastening portion for fastening a motor harness of the motor thereto, wherein the motor harness fastening portion includes a recess formed at a rim portion which forms an outside circumferential surface of the tub back and a hole formed in the rim portion, and wherein the motor harness fastening portion includes a fastening boss projected from the tub back, a holder for holding the motor harness, and a fastener for fastening the holder to the fastening boss.

11. The laundry machine as claimed in claim 10, wherein the tub has reinforcing ribs on an outside circumferential surface for reinforcing strength of the tub.

12. The laundry machine as claimed in claim 11, wherein the fastening means is an extension from the reinforcing rib.

13. The laundry machine as claimed in claim 10, wherein the fastening means includes a projection plate having a plurality of cable holes formed therein, and a cable tie for fastening the wire harness passed through the cable hole in the projection plate.

14. The laundry machine as claimed in claim 10, wherein the fastening means includes a nut projection having a nut hole, a holder for surrounding and holding the wire harness, and a screw member for fastening the nut projection to the holder.

15. The laundry machine as claimed in claim 10, wherein the fastening means includes hook projection projected from an outside surface of the tub to have a recess for placing the wire harness therein.

16. The laundry machine as claimed in claim 15, wherein the tub includes a tub front and a tub rear, and the fastening means is formed at a contact portion of the tub front or the tub rear.

17. The laundry machine as claimed in claim 10, wherein a plurality of the fastening means are arranged along a side surface of an outside side of the tub at fixed intervals.

18. The laundry machine as claimed in claim 10, wherein the fastening means includes;

a first fastening means projected from an outside surface of the tub, having a projection plate with a plurality of cable holes, and a cable tie passed through the cable holes to fasten the wire harness, a second fastening means projected from the outside surface of the tub, having a nut projection having a nut hole, a holder surrounding and fastening the wire harness, and a screw member for fastening the holder to the nut projection, and a third fastening means projected from the outside surface of the tub, having a hook projection having a recess for placing the wire harness therein.

* * * * *